US009215928B2

(12) United States Patent
Royden et al.

(10) Patent No.: US 9,215,928 B2
(45) Date of Patent: Dec. 22, 2015

(54) EXPANDABLE PODIUM

(75) Inventors: James Royden, Arsta (SE); Jerk Thomsgard, Stockholm (SE)

(73) Assignee: KG SPENNARE AB, Nacka (SE)

( * ) Notice: Subject to any disclaimer, the term of this patent is extended or adjusted under 35 U.S.C. 154(b) by 29 days.

(21) Appl. No.: 14/123,162

(22) PCT Filed: Jan. 23, 2012

(86) PCT No.: PCT/SE2012/050057

§ 371 (c)(1), (2), (4) Date: Nov. 29, 2013

(87) PCT Pub. No.: WO2012/166037

PCT Pub. Date: Dec. 6, 2012

(65) Prior Publication Data

US 2014/0130718 A1 May 15, 2014

(30) Foreign Application Priority Data

May 30, 2011 (SE) ..... 1150500

(51) Int. Cl.
*A47B 96/18* (2006.01)
*A47B 85/00* (2006.01)
(Continued)

(52) U.S. Cl.
CPC ..... *A47B 85/00* (2013.01); *A47B 19/02* (2013.01); *A47B 19/08* (2013.01); *A47F 5/10* (2013.01); *A47F 9/00* (2013.01); *A47B 2220/0072* (2013.01)

(58) Field of Classification Search
CPC ..... A47B 45/00; A47B 85/00; A47B 19/02; A47B 43/00; A47B 69/00; A47B 19/08; A47F 5/10
USPC ..... 312/140.2, 205
See application file for complete search history.

(56) References Cited

U.S. PATENT DOCUMENTS 1,956,097 A * 4/1934 Hofstad ..... 190/5
2,535,646 A * 12/1950 Medwin ..... 108/63
(Continued)

FOREIGN PATENT DOCUMENTS

CH 167973 A 3/1934
EP 2 229 843 A2 9/2010
(Continued)

OTHER PUBLICATIONS

International Search Report, dated Sep. 4, 2012, from corresponding PCT application.
(Continued)

*Primary Examiner* — Matthew Ing
*Assistant Examiner* — Timothy M Ayres
(74) *Attorney, Agent, or Firm* — Young & Thompson

(57) ABSTRACT

An expandable podium has a first part (2) which includes a supporting base panel (7) and a rear panel (8) rising from the base panel, a second part (3) which includes a top panel (9) and a front panel (10) depending from the top panel, wherein in expanded mode of the podium a lower hinge (5) links a bottom corner (10') of the front panel to the nearest forward corner of the base panel and an upper hinge links a top corner (8') of the rear panel to the nearest rearward corner of the top panel, each of the upper and lower hinges forming an elongate element the ends of which are connected pivotally to the appertaining base, top, front and rear panels about a respective pivot axis. The pivot axes extend at converging directions that intersect in a common point of intersection, beyond the rear panel.

14 Claims, 4 Drawing Sheets

(51) Int. Cl.

| | |
|---|---|
| ***A47B 19/02*** | (2006.01) |
| ***A47B 19/08*** | (2006.01) |
| ***A47F 5/10*** | (2006.01) |
| ***A47F 9/00*** | (2006.01) |

(56) References Cited

U.S. PATENT DOCUMENTS

| | | | | | |
|---|---|---|---|---|---|
| 2,725,274 | A | * | 11/1955 | Stivale | 312/290 |
| 3,027,210 | A | * | 3/1962 | Eames et al. | 312/6 |
| 3,140,133 | A | * | 7/1964 | Kraft | 312/140.2 |
| 3,353,885 | A | * | 11/1967 | Hanson | 312/205 |
| 3,527,340 | A | * | 9/1970 | Cipolla | 206/278 |
| 3,588,209 | A | * | 6/1971 | Nathan | 312/140.2 |
| 3,841,728 | A | * | 10/1974 | Petersen et al. | 312/140.2 |
| 4,436,353 | A | * | 3/1984 | Tucker | 312/241 |
| 5,382,087 | A | | 1/1995 | Pouch | |
| 6,189,594 | B1 | | 2/2001 | Carter | |
| 6,601,723 | B1 | * | 8/2003 | Ziglar | 220/4.34 |
| 2011/0042910 | A1 | | 2/2011 | Ceballos-Godefroy | |

FOREIGN PATENT DOCUMENTS

| | | | |
|---|---|---|---|
| ES | 232826 | U | 2/1978 |
| MX | PA03000030 | A | 2/2011 |
| WO | 9410462 | A1 | 5/1994 |
| WO | 2011017751 | A1 | 2/2011 |

OTHER PUBLICATIONS

Extended European Search Report, dated Sep. 30, 2014, from corresponding EP application.

* cited by examiner

1

2
3

2
3
4
5

11
8
4
9'
8'
9
7
9'
5
10'
10
12

I.P.
D1
D2
D3
D4

6
28
10
24

EXPANDABLE PODIUM

TECHNICAL FIELD OF THE INVENTION

The present invention refers to a podium which is expandable with respect to its width. The podium is adapted for use as a speaker's podium, as a display counter or presentation podium, e.g.

BACKGROUND AND PRIOR ART

The podium is an article that is frequently used at exhibitions, trade fairs and other similar events, wherein the podium provides top and front surfaces onto which display and presentation material can be attached and supported. A podium for these purposes, in this context often also named a counter, is typically made pivotally foldable about a vertical axis in order to facilitate transportation while still providing adequate display surfaces in the un-folded/expanded mode of the podium. The podium is often mobile on wheels which can be integrated in a bottom region of the structure, or separately provided and attachable to the base of the podium.

At exhibitions, trade fairs and other events it is a general desire to have access to a large and noticeable display format, without unnecessarily increasing weight and dimension of the podium in transportation mode, and without unnecessarily complicating the folding/unfolding procedure.

Existing, foldable podium products are however limited to a maximum expansion of approximately two times the width and display area of the podium in folded condition.

SUMMARY OF THE INVENTION

It is thus an object of the present invention to provide a podium which can be expanded above the double width of the podium in non-expanded mode, without adding to the structural weight or dimensions of the podium.

Another object of the present invention is to provide a podium which can be shifted between expanded and non-expanded modes through a simple, manual shifting manoeuvre.

The objects are met in a podium, a first part of which comprises a supporting base panel and a rear panel rising from the base panel, a second part of which comprises a top panel and a front panel depending from the top panel, wherein in expanded mode of the podium a lower hinge links a bottom corner of the front panel to the nearest forward corner of the base panel and an upper hinge links a top corner of the rear panel to the nearest rearward corner of the top panel, each of the upper and lower hinges forming an elongate element the ends of which are connected pivotally to the appertaining base, top, front and rear panels about a respective pivot axis, and further wherein the pivot axes extend at converging directions that intersect in a common point of intersection, beyond the rear panel.

In other words, the second portion of the podium is movable in a spherical path of movement relative to the first portion. The arrangement of a spherical linkage not only minimizes the risk of hinges jamming, but ensures also a smooth motion and a natural manual handling as well. In expanded mode, the podium provides a width and a frontal display area substantially equaling three times the width and front area of the podium in non-expanded mode.

As a consequence of linking the separate parts of the podium through the spherical linkage, the first and second parts will be laterally separated and angularly spaced on a circular arc in the expanded mode of the podium. This is also a characterizing feature of the invention which provides a simplified manual manoeuvre involving a slight twist of the operator's body but requires no other shifting of bodily position. In addition, the curved front of the expanded podium adds to the esthetical appearance of the product, and improves the exposure of display material that has been attached to the front of the podium.

In a preferred embodiment, the first and second parts of the podium each comprises a side panel adjoining a longitudinal edge of the front and rear panels respectively, the first and second parts of the podium in non-expanded mode together forming a closed cabinet. The embodiment provides for safe storage of display material and other articles inside the podium.

The basics of the presented solution can be applied in different embodiments of the invention. In alternative to the above configuration, wherein the base and rear panels are connected to form a first part of the podium and the top and front panels are connected to form the other part, the panels may be otherwise combined. Accordingly, as used herein, the attributed definitions front and rear shall be understood merely as indicative of a viewing direction, and can be mutually exchanged without changing the scope of invention which is not limited to the language that is applied for the purposes of explanation and understanding.

Bearing the above said in mind, a preferred embodiment foresees that, in expanded mode, the lower hinge links a bottom corner of the front panel to the nearest forward corner of the base panel. The same preferred embodiment foresees that the upper hinge links a top corner of the rear panel to the nearest rearward corner of the top panel, in the expanded mode of the podium.

A smoothly curved and highly esthetical front surface for supporting of display material can be achieved when, according to a preferred embodiment, the front panel is made convexo-concave in horizontal section. In other words, the forward face of the front panel is convex, and the rear face of the front panel is concave.

The lower hinge may advantageously be curved in conformity with the convexo-concave section of the front panel. In non-expanded mode, the lower hinge lies concealed inside the closed cabinet, following a forward edge of the base panel.

In the ends of the lower hinge, the lower hinge is angled and configured for mounting the lower hinge pivotally about the converging pivot axes.

According to one preferred embodiment of the invention a length of the upper hinge projects outside the rear panel in the non-expanded mode of the podium, said length of the upper hinge following at a small distance a rearward edge of the top panel so as to provide an accessible handle for transportation of the closed cabinet. This duplicate function can be achieved since the upper hinge comprises a handle portion, in each opposite end adjoining a mounting bracket which extends forwardly offset from the handle portion, the mounting brackets angled and configured for mounting the upper hinge pivotally about converging pivot axes.

Among other advantageous features to be mentioned in connection with preferred embodiments are, e.g.: wheels for transportation which are journalled in the base panel; handles for gripping formed in the top panel and used by the operator for shifting the podium between expanded and closed modes, as well as fixtures arranged inside the first and/or second part of the podium for support of one or more inserts adapted for holding accessories, presentation material, etc.

SHORT DESCRIPTION OF THE DRAWINGS

The invention will be further explained below with reference made to the accompanying drawings, schematically illustrating embodiments of the new podium. In the drawings, FIGS. 1*a*-1*f* illustrate in six snapshots the motion by which the non-expanded podium (FIG. 1*a*) is shifted into the fully expanded mode (FIG. 1*f*);

DETAILED DESCRIPTION OF PREFERRED EMBODIMENTS

Figures 1A, 1B, 1C, 1D, 1E, 1F:
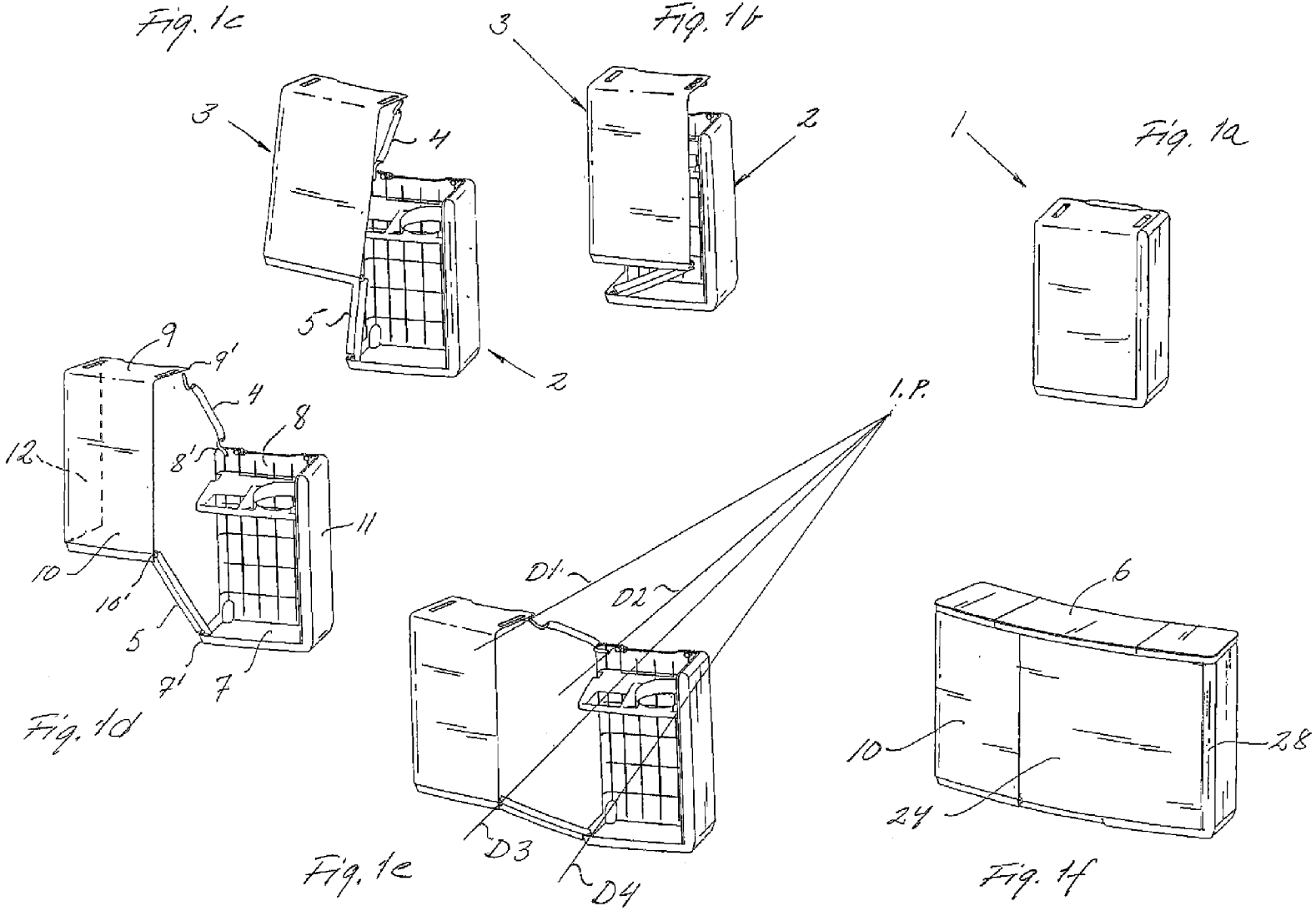

FIG. 1*a* shows the podium 1 in non-expanded mode, resting with its base onto a floor.

In FIG. 1*b* one part of the podium 1 is lifted up and separated from another part which remains standing on the floor. In the rest of the disclosure, the remaining part is named a first part 2, and the movable part is named a second part 3.

In FIG. 1*c* the second part 3 is further lifted and separated from the first part 2, the movable part 3 approaching a peak of a swinging motion which is controlled through upper and lower hinges 4 and 5, respectively, pivotally linking the second part 3 to the first part 2 of the podium 1.

In FIG. 1*d* the swinging motion has passed its highest point, and the second part 3 is lowering towards the floor.

In FIG. 1*e* the expansion is almost finished.

In FIG. 1*f* the fully expanded podium is completed through a supplementary front cover and a table top which is put to rest on the top of the expanded podium.

The series of snapshots through FIGS. 1*a* to 1*f* illustrates the transformation from a non-expanded format adapted for transportation in FIG. 1*a*, to the expanded format of FIG. 1*f* resulting in a substantial increase of the width and area which can be used for presentation purposes. Upon comparing FIG. 1*a* to FIG. 1*f* it is readily seen that the useful width and area of the expanded podium is more than double and close to three times the width and area of the podium in non-expanded mode.

The separate elements which are built into the structure of the new podium are now to be explained with reference made also to FIGS. 2-4 of the drawings.

The first podium part 2 comprises a supporting base panel 7, a rearward edge of which is connected to the lower edge of a rear panel 8 which rises from the base panel. The second podium part 3 comprises a top panel 9, a forward edge of which connects to the upper edge of a front panel 10, depending/hanging down from the top panel. The podium parts 2 and 3 each comprises a side panel 11 and 12, respectively, adjoining opposite forward and rearward vertical edges of the rear and front panels. Thus in the non-expanded mode, the podium 1 takes the shape of a closed cabinet.

The first and second parts are movably linked through the upper and lower hinges 4 and 5. As is best seen in FIG. 1*c* to FIG. 1*e*, the upper and lower hinges are in each respective end linked to the first and second parts of the podium. More precisely, the upper hinge 4 links a top corner 8' of the rear panel 8 to the nearest rearward corner 9' of the top panel 9. Correspondingly, the lower hinge 5 links a bottom corner 10' of the front panel 10 to the nearest forward corner 7' of the base panel 7.

The upper and lower hinges 4 and 5 are in each end journalled to swing about a pivot, respectively, that links the hinge pivotally to the respective panel of the podium 1. Naturally, the pivot connection between a hinge and a podium panel can be realized in alternative ways. For example, a pivot pin 34 may be fixedly arranged in the end of the top or lower hinge to be received for rotation in a corresponding bore formed in the podium panel. Alternatively, pivot pins may be mounted on the podium panels, and in the panels positioned and oriented to be received for rotation in corresponding bores formed in the ends of the upper and lower hinges. The joints between the upper and lower hinges and each podium part or panel are in each case configured such that the upper and lower hinges are journalled to swing about non-parallel pivot axes.

More precisely, the upper and lower hinges are journalled to swing about pivot axes which extend at converging directions that intersect in a common, imaginary point of intersection IP, at a distance beyond the rear panel of the podium. In FIG. 1*e*, the extensions of the four pivot axes are illustrated as four lines of direction D1, D2, D3 and D4. The upper and lower hinges 4 and 5 thus form a linkage by which the second part 3 of the podium is movable in a spherical path of movement relative to the first part 2. In expanded mode, the second part 3 will be laterally separate and angularly spaced from the first part 2 on a circular arc A whose centre is the point of intersection between the pivot axes' extensions D1 to D4.

Figure 3:
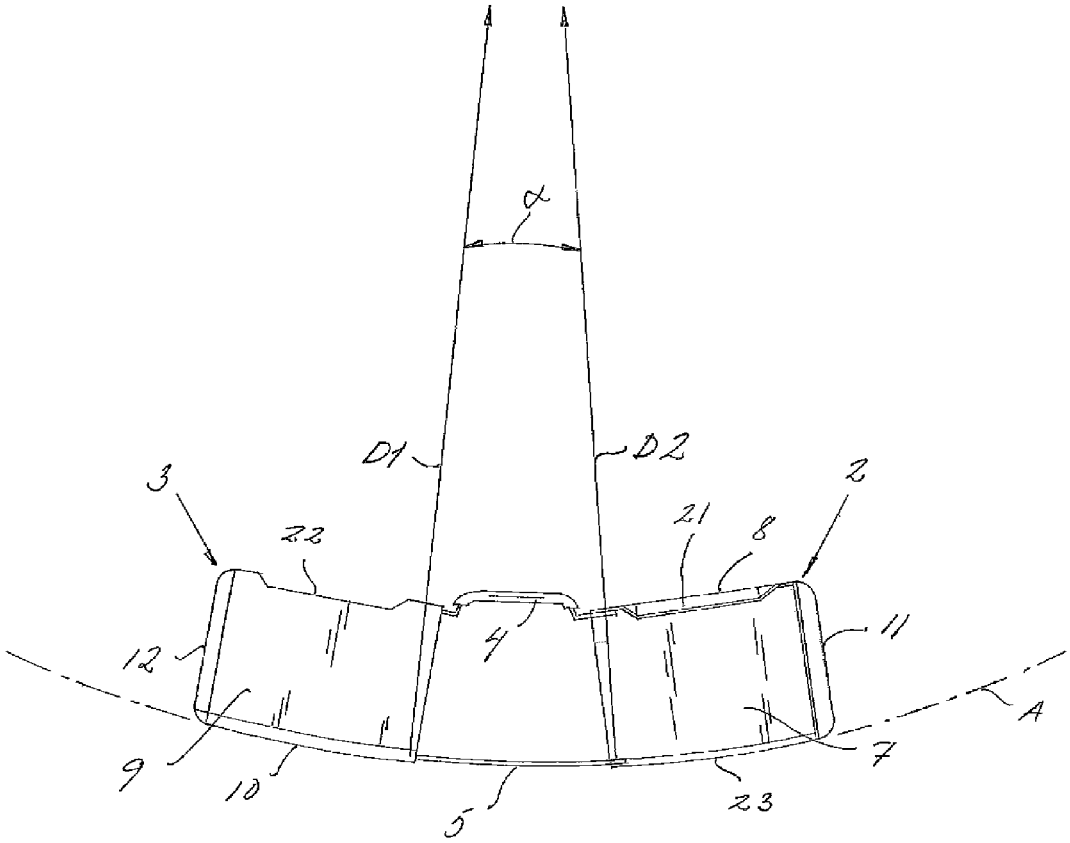
FIG. 3 is a top view showing the podium in fully expanded mode.

FIG. 3 is a view from above showing the podium in its expanded mode, illustrating also the converging pivot axes D1 and D2 which pivotally connect the upper hinge 4 to the parts of the podium. In FIG. 3, the pivot axes D3 and D4 to the lower hinge 5 run vertically underneath the pivot axes D1, D2 and are thus hidden in the top view.

Figure 4:
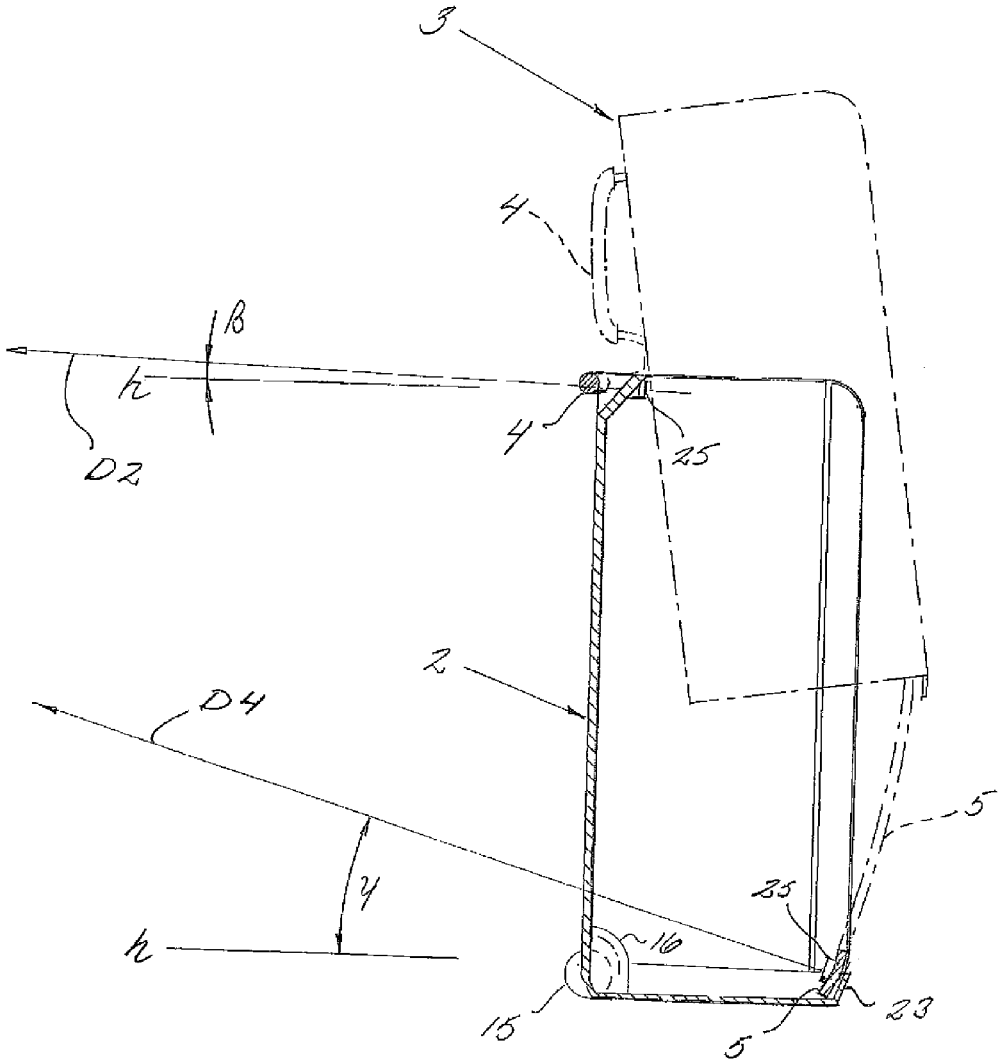
FIG. 4 is a side view and vertical section through the podium in non-expanded mode and, in dash-dot lines, at the peak of a swinging motion between expanded and non-expanded modes.

FIG. 4 is a side view and vertical section through the podium, showing the orientation of the pivot axes D1-D4 in a vertical plane. Only the pivot axes D2 and D4 are visible in FIG. 4 whereas the pivot axes D1 and D3 are cut away, however, these will have the same inclination with respect to the horizontal h as the illustrated pivot axes D2, D4 (in non-expanded and fully expanded modes, i.e.). In a preferred embodiment of the invention the pivot axes D1 to D4 are oriented such that the point of intersection between the pivot axes lies at a level that is higher above the floor than the top of the podium 1. In result, the movable podium part 3 will move slightly inclined from the vertical through the peak of the swinging motion between non-expanded and expanded modes. The inclined position at the peak of the swinging motion is illustrated through dash-dotted lines in FIG. 4. This embodiment facilitates separation of the podium parts and provides for expansion of the podium through a smooth and ergonomic manual manoeuvre.

Naturally, the angular distances between the pivot axes D1-D4 will depend on the actual dimensions of the podium 1 and the desired curvature of the podium in expanded mode. The following approximative data is therefore merely to be understood as indications intended for guiding the skilled person, and shall not be interpreted as limitations to the present invention. Thus, in a podium having a height of about 1000 mm, a width of about 600 mm and a depth dimension of about 400 mm, the intermediate angle $\alpha$ between pivot axes D1 and D2 (and between pivot axes D3 and D4, respectively) may amount to approximately 9-10° in a horizontal view (see FIG. 3), resulting in a corresponding angular spacing between the first and second podium parts in expanded mode. In a vertical view, see FIG. 4, the pivot axes D1 and D2 may be arranged at a sloping angle β of about 1-2° relative to the horizon h, from the point of intersection through the pivots of the upper hinge 4. On the other hand, the pivot axes D3 and D4 may be arranged at a sloping angle γ of about 15-18° relative to the horizon h, from the point or intersection through the pivots of the lower hinge 5. Given these circumstances, the point of intersection IP will be located at a distance of about 3200-3500 behind the rear panel 8 of the podium.

Figure 2:
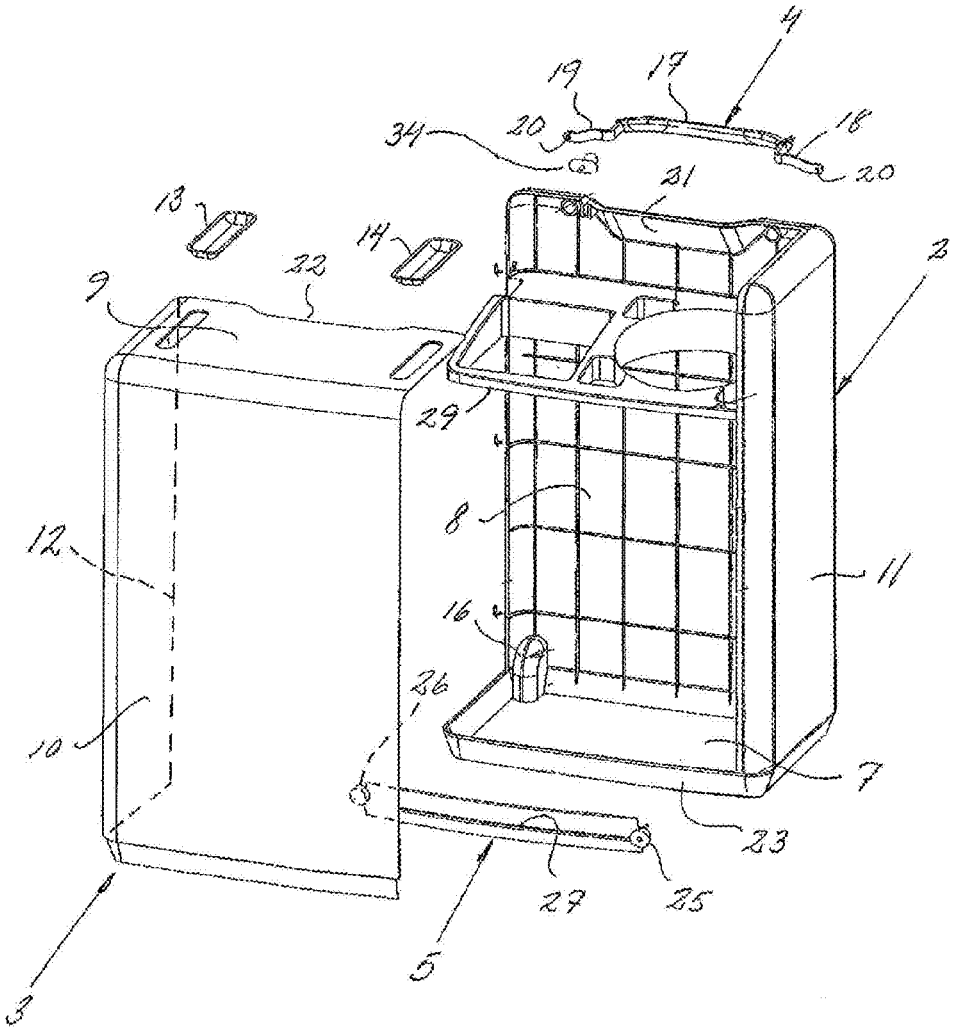
FIG. 2 is an exploded three-dimensional view showing the separate elements of a podium according to the invention.

Manual separation of the two podium parts is facilitated through handles 13, 14 for gripping by the operator's hands, arranged in the top panel 9 of the movable podium part 3 (see FIG. 2).

Transportation of the podium 1 is facilitated through wheels 15 arranged in a bottom region of the podium. In the illustrated embodiment, wheel houses 16 are formed at the angular connection between the base panel and the rear panel, in the two rearward corners of the base panel 7.

Also for the purpose of facilitating transportation, the upper hinge 4 is shaped to project outside the rear panel 8 in the non-expanded mode of the podium. The upper hinge 4 comprises a handle portion 17 which in each opposite end carries a mounting bracket 18 and 19, respectively. The mounting brackets 18, 19 extend forwardly offset and at an angle from the ends of the handle portion, the mounting brackets configured with bores 20 for mounting the upper hinge pivotally about pivot pins that are oriented on the converging pivot axes D1 and D2.

In non-expanded mode, the rearward offset handle portion 17 is received in a pocket 21 formed in the upper edge of the rear panel 8. A clearance 22 in the rearward edge of the top panel 9 provides access to the handle portion 17 for transportation.

In non-expanded mode the lower hinge 5 lies concealed inside the podium. In a preferred and appealing design, the front panel 10 is curved with a convexo-concave sectional profile. The lower hinge 5 and the forward edge of the base panel 7 are curved accordingly, the lower hinge in non-expanded mode closely following inside a curved rim 23 rising from the forward edge of the base panel 7 (see FIG. 4). This embodiment provides a support surface which is adapted for an esthetical presentation of a poster or a podium cover 24 (see FIG. 1*f*), spanning at least the gap between the separated podium parts thus covering the open interior of the stationary part 2. The lower hinge 5 comprises in each end a journal 25 and 26, respectively, for mounting the lower hinge to pivot pins that are oriented on the converging pivot axes D3 and D4. The lower hinge 5 may advantageously be formed with a shoulder or slot 27 that provides support for the lower edge of the poster or cover. The poster or cover may be provided in the form of a roll-out curtain that is housed in the forward vertical post 28 of the stationary podium part 2.

The podium parts 2 and 3 may be manufactured and assembled from moulded plastic components, whereas the upper and lower hinges may be produced from metal or combinations of metal and synthetic material. Seats or sockets adapted for mounting of metal pivot pins may be formed directly in the moulded components, or provided as separate journal bearing details which are mountable to the podium parts. The interiors of the first and/or second podium parts may be formed with fittings for attachment of inserts for organization and storage of presentation material and personal effects, e.g., such as indicated in the drawings by a utensils tray 29. The podium top 6 (see FIG. 1*f*) may be provided as a light-weight plastic component that is foldable twice for storage inside the closed cabinet.

The invention claimed is:

1. An expandable podium, comprising:

a first part (2), which includes a supporting base panel (7) and a rear panel (8) rising from the base panel; and a second part (3), which includes a top panel (9) and a front panel (10) depending from the top panel, wherein, in an expanded mode of the podium, a lower hinge (5) links a bottom corner (10') of the front panel to a forward corner (7') of the base panel, and an upper hinge (4) links a top corner (8') of the rear panel to a rearward corner (9') of the top panel, each of the upper and lower hinges forming an elongate element, ends of which being connected pivotally to the appertaining base, top, front, and rear panels about a respective pivot axis (D1, D2, D3, D4), and wherein the pivot axes (D1, D2, D3 and D4) extend at converging directions that intersect in a common imaginary point of intersection (IP), beyond the rear panel.

2. The podium according to claim 1, wherein the first and second parts of the podium each comprises a side panel (11, 12) adjoining a longitudinal edge of the front and rear panels respectively, the first and second parts of the podium in non-expanded mode together forming a closed cabinet (1).

3. The podium according to claim 1, wherein in expanded mode the first and second parts are laterally separated and angularly spaced on a circular arc.

4. The podium according to claim 1, wherein in non-expanded mode the lower hinge lies concealed inside the closed cabinet, following a forward edge (23) of the base panel.

5. The podium according to claim 1, wherein the front panel (10) is convexo-concave in horizontal section.

6. The podium according to claim 5, wherein the lower hinge (5) is curved in conformity with the convexo-concave section of the front panel (10).

7. The podium according to claim 6, wherein the ends (25, 26) of the lower hinge are configured for mounting the lower hinge pivotally about converging pivot axes (D3, D4).

8. The podium according to claim 1, wherein in non-expanded mode a length of the upper hinge (4) projects outside the rear panel, following a rearward edge (22) of the top panel, forming a handle (17) for transportation of the closed cabinet.

9. The podium according to claim 8, wherein the upper hinge (4) comprises a handle portion in each opposite end adjoining a mounting bracket (18, 19) which extends forwardly offset from the handle portion (17), the mounting brackets angled and configured (20) for mounting the upper hinge pivotally about converging pivot axes (D1, D2).

10. The podium according to claim 1, wherein the second portion of the podium is movable in a spherical path of movement relative to the first portion, between expanded and closed modes.

11. The podium of claim 1, further comprising:

wheels (15) for transportation journalled in the base panel.

12. The podium of claim 1, further comprising:

handles (13, 14) for manual gripping formed in the top panel (9) for shifting the podium between expanded and closed modes.

13. The podium of claim 1, further comprising:

an insert (29) supported inside the first and/or inside the second part of the podium.

14. The podium of claim 1, further comprising:

a separate podium top (6) twice foldable for storage in the podium.

* * * * *